US006173951B1

(12) United States Patent
Inoue et al.

(10) Patent No.: US 6,173,951 B1
(45) Date of Patent: Jan. 16, 2001

(54) SHEET FEEDER FOR FEEDING ONE SHEET AT A TIME FROM SHEET STACK REGARDLESS OF THICKNESS AND WEIGHT OF SHEETS

(75) Inventors: Mitsuaki Inoue, Tsu; Kazumasa Makino, Nagoya; Tetsuo Asada, Kuwana, all of (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/144,091

(22) Filed: Aug. 31, 1998

(30) Foreign Application Priority Data

Sep. 1, 1997 (JP) ..... 9-235559

(51) Int. Cl.[7] ..... B65H 3/52; B65H 3/06

(52) U.S. Cl. ..... 271/121; 271/109; 271/117; 271/119

(58) Field of Search ..... 271/121, 124, 271/125, 109, 113, 117, 118, 119, 120; 384/276, 280, 281, 282, 283, 296

(56) References Cited

U.S. PATENT DOCUMENTS 5,244,191 * 9/1993 Kanekura ..... 271/10.11
5,570,876 * 11/1996 Samii ..... 271/119
5,582,399 * 12/1996 Sugiura ..... 271/10.11
5,934,664 * 8/1999 Murayama et al. ..... 271/118

* cited by examiner

*Primary Examiner*—Donald P. Walsh
*Assistant Examiner*—Brett C. Martin
(74) *Attorney, Agent, or Firm*—Oliff & Berridge, PLC

(57) ABSTRACT

A sheet feeder provided with a feed roller having a circumferential surface portion and a cutout surface portion and capable of reliably feeding sheets regardless of the thickness and weight of the recording medium. The feed roller has a roller shaft extending from both side thereof. Each roller has an inner peripheral surface through which the roller shaft extends, and has an outer peripheral portion serving as a contact portion for contacting with a separation pad when the cutout surface portion is in confrontation with the pad. An annular space is provided between the inner peripheral surface of the roller and an outer peripheral surface of the roller shaft. A spacer is movable over the roller shaft and is insertable into and rectactable from the annular space. In the insertion position, a distance between an axial center of the roller shaft and the contact portion is increased. In the retracted position, the distance is decreased because of the urging of the separation pad toward the roller.

20 Claims, 5 Drawing Sheets

SHEET FEEDER FOR FEEDING ONE SHEET AT A TIME FROM SHEET STACK REGARDLESS OF THICKNESS AND WEIGHT OF SHEETS

BACKGROUND OF THE INVENTION

The present invention relates to a sheet feeder provided in an image forming device such as a copy machine, laser printer, and facsimile machine, and more particularly, to a sheet feeder for feeding stacked sheets of a recording medium one sheet at a time.

An example of a conventional sheet feeding device provided in image forming devices such as copy machines, laser printers, and facsimile devices is shown in FIG. 10. This sheet feeding device is provided with a feed roller 1 and a separating pad 3 opposite the feed roller 1 for conveying a sheet 2 of a recording medium one sheet at a time from a stack of sheets. The separating pad 3 is inset into a depression formed in a sheet receiving portion 5 of a separating pad holder 4. The separating pad holder 4 is urged toward the feed roller 1 by a spring 7 interposed between a fixed stop member 6 and the bottom surface of the sheet receiving portion 5. The feed roller 1 is formed of an elastic material in an approximate D-shape and includes a circumferential surface portion 8 for contacting and conveying the sheet 2 and a cutout surface portion 9 formed by cutting away a portion of the circumferential surface portion 8. Rollers 10 are rotatably mounted on both ends of the feed roller 1. Both of the rollers 10 are formed with a radius slightly smaller than the radius of the circumferential surface portion 8. Hence, when the circumferential surface portion 8 is conveying the sheet 2, the rollers 10 do not contact the sheet 2. However, when the circumferential surface portion 8 has completed conveying the sheet 2 and the cutout surface portion 9 opposes the sheet 2, the peripheral surfaces of the two rollers 10 contact the sheet 2 and oppose the urging force of the separating pad 3, thereby forming a space between the cutout surface portion 9 and the sheet 2 to prevent the cutout surface portion 9 from contacting the sheet 2.

Guide rollers 12 and 13 are positioned downstream of the feed roller 1 and convey the sheet 2 after the circumferential surface portion 8 has completed conveying the sheet 2. Although not shown in the drawings, each time the feed roller 1 conveys a sheet 2, the rotation of the feed roller 1 is suspended for a predetermined period when the cutout surface portion 9 is brought into confrontation with the sheet 2 and the two rollers 10 separate the cutout surface portion from the sheet. In this case, the rollers 10 contact and rotate on the top surface of the sheet 2, while the guide rollers 12 and 13 convey the sheet 2, thereby allowing only one sheet 2 to be conveyed at a time.

However, when conveying the sheet 2 in this way, the circumferential surface portion 8 and the rollers 10 contact the sheet 2 and separating pad 3 at different heights, because the radius of the two rollers 10 is smaller than the radius of the circumferential surface portion 8. This difference in radii creates a bump when the sheet 2 and separating pad 3 change from contacting the rollers 10 to contacting the circumferential surface 8 and vice versa, causing the separating pad 3 to move upward and downward.

SUMMARY OF THE INVENTION

If the difference in radii is large, then when the sheet 2 and separating pad 3 contacted by the two rollers 10 comes in contact with the circumferential surface portion 8 of the feed roller 1, the circumferential surface portion 8 pushes down on the sheet 2 and separating pad 3 due to the difference in radii, causing a large fluctuation in pressure at that moment. This fluctuation in pressure invites a plurality of sheets 2, sometimes referred to as doubles, to be fed simultaneously between the circumferential surface portion 8 and the separating pad 3, particularly when the sheet 2 recording medium is thin or lightweight. On the other hand, if the difference in radii is small, the circumferential surface portion 8 does not push very strongly on the sheet 2 or separating pad 3, but the pressure needed to convey the sheet 2 is low, inviting the occurrence of empty feeds, in which the sheet 2 is not fed. This is particularly common when the sheet 2 is thick or heavy.

Hence, this construction for conveying a sheet of recording medium by a feed roller having a circumferential surface portion and a cutout surface portion has conflicting properties, in that feeding of doubles can occur easily if the difference in radii described above is large, while empty feeds can occur if the difference is small. As a result, it is not possible to design a device that can reliably feed sheets regardless of the thickness and weight of the sheet, thereby lowering the degree of freedom in design.

In view of the foregoing, it is an object of the present invention to provide a sheet feeder configured with the feed roller having the circumferential surface portion and the cutout surface portion and capable of reliably feeding sheets of a recording medium regardless of the thickness, weight, and other qualities of the recording medium.

This and other objects of the present invention will be attained by providing a sheet feeder for feeding each sheet of recording medium, the sheet feeder includes a feed roller, a separating pad, a space forming member, and means for changing a distance. The feed roller has a roller shaft defining an axial center and a roller body provided with a circumferential surface portion having a first radius for contacting and conveying a sheet of a recording medium, and a cutout surface portion formed by cutting out a portion of the circumferential surface portion. The separating pad opposes the feed roller and is urged toward the feed roller for interposing the sheet between the separating pad and the feed roller. The space forming member has a contact portion contacting the sheet and the separating pad and forms a space between the cutout surface portion and the separating pad when the cutout surface portion is opposite to the separating pad. The space forming member is provided around the roller shaft. The distance changing means is adapted for changing a distance from the axial center to the contact portion. The changing means is provided in association with the space forming member and the roller shaft.

In another aspect of the invention, there is provided an image forming device includes a casing, at least one cassette, the sheet feeder, a pair of guide rollers, and an image forming unit. The casing has at least one cassette accommodating section. The at least one cassette maintains a stack of sheets and is detachably mounted on the at least one cassette accommodating section. The sheet feeder is provided immediately downstream of the at least one cassette, the sheet feeder includes the above described feed roller, the separation pad, the space forming member, and means for changing the distance from the axial center to the contact portion. The pair of guide rollers are provided immediately downstream of the sheet feeder for conveying each sheet fed by the sheet feeder. The image forming unit is positioned downstream of the pair of guide rollers for forming an image on the sheet fed by the pair of guide rollers. The image forming unit includes a photosensitive drum and a transfer roller in confronting relation to the photosensitive drum.

DETAILED DESCRIPTION OF THE PREFERRED EMBODIMENTS

A sheet feeder according to a first embodiment of the present invention will be described while referring to FIGS. 1 through 7.

Figure 1:
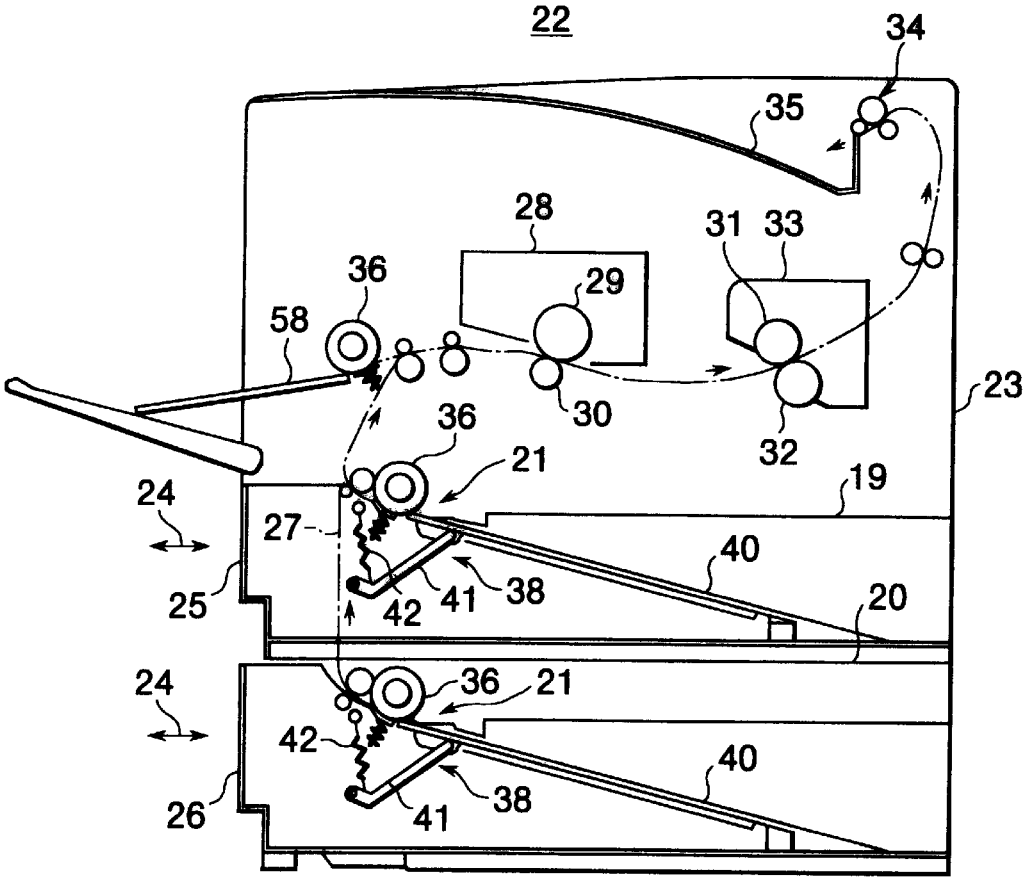
FIG. 1 is a cross-sectional view showing a relevant parts of a laser printer, which printer is mounted with a sheet feeder according to one embodiment of the present invention.

FIG. 1 shows a laser printer 22 provided with a sheet feeder according to the embodiment. The laser printer 22 includes a printer casing 23. The lower portion of the printer casing 23 is formed with a first cassette accommodating section 19 and a second cassette accommodating section 20. A first cassette 25 and a second cassette 26 are housed in the first cassette accommodating section 19 and second cassette accommodating section 20, respectively, for maintaining stacks of paper or overhead projector sheets 27. The first cassette 25 and second cassette 26 are capable of sliding freely in and out of the first cassette accommodating section 19 and second cassette accommodating section 20 in a direction indicated by arrows 24. The upper portion of the printer casing 23 is provided with an image forming unit 28 for forming a toner image and transferring the image to the sheet 27, and a fixing unit 33 for fixing a toner image on the sheet 27. The image forming unit 28 is provided with a toner cartridge, a charging device, and the like. The lower portion of the image forming unit 28 is provided with a photosensitive drum 29 and a transfer roller 30 in confronting relation to the photosensitive drum 29. The fixing unit 33 is provided with a heating roller 31 and a pressure roller 32 in contact with the heating roller 31.

Each sheet 27 fed from either the first cassette 25 or the second cassette 26 is conveyed between the photosensitive drum 29 and transfer roller 30, at which time a toner image is transferred to the sheet 27. Subsequently, the sheet 27 is conveyed between the heating roller 31 and pressure roller 32, at which time the transferred toner image is fixed to the sheet 27. Finally, the sheet 27 is discharged by a discharge roller 34 onto a receiving tray 35.

Each of the first cassette 25 and second cassette 26 provided in the bottom section of the printer casing 23 is provided with a receiving plate 40 for receiving the stack of sheets 27. The bottom end of the receiving plate 40 (right side of the diagram) is rotatably supported near the bottom of the each cassette. The front end of the receiving plate 40 (left side of the diagram) is supported by a pivot arm 41. That is, the front end of the receiving plate 40 is mounted on a rear end of the pivot arm 41. The rear end of the pivot arm 41 is slidable with respect to the bottom surface of the front portion of the receiving plate 40. A front end of the pivot arm 41 is rotatably supported at a lower position on the frame of the cassette. An urging spring 42 is fixed between an upper portion on the frame of each cassette 25 (26) and the pivot arm 41, so that the pivot arm 41 is urged to be pivotally moved in a counterclockwise direction about the front pivot end of the pivot arm 41. Thus, the sheets 27 stacked on top of the receiving plate 40 are urged toward a feed roller 36 described later. The receiving plate 40, the pivot arm 41 and the urging spring 42 are all components of a sheet urging device 38.

The feed roller 36 and a separating pad 37 opposing the feed roller 36 are provided at the front end side of the receiving plate 40. With this configuration, a sheet 27 from a stack of sheets in either the first cassette 25 or second cassette 26 is interposed between the feed roller 36 and separating pad 37 (FIG. 5) and conveyed toward the image forming unit 28. The laser printer 22 also includes a manual insertion tray 58 for inserting a sheet of recording material by hand one sheet at a time. A combination of the feed roller 36 and the separating pad 37 is also provided at immediately downstream of the manual insertion tray 58.

Next, the process of feeding the sheets 27 by the feed roller 36 and separating pad 37 will be described with reference to FIGS. 2 through 7. The feed roller 36 includes a roller shaft 43, and a roller body 44 formed of an elastic material such as rubber with a relatively high frictional coefficient. The roller body 44 is formed in an abbreviated cylindrical shape having a cross-section shaped approximately like the letter D. The roller body 44 has a circumferential surface portion 45 for contacting and conveying the sheet 27 and a cutout surface portion 46 formed by cutting away part of the circumferential surface portion 45. The circumferential surface portion 45 also includes an entry contact portion 55 for first contacting the sheet 27 during the feeding process and an exit contact portion 56 for last contacting the sheet 27.

Two rollers 48 are rotatably provided around the roller shaft 43 on each side of the feed roller 36. The rollers 48 are circularly shaped and formed with a hollow cylindrical space 64. The rollers 48 are loosely fitted around the roller shaft 43 to provide enough play between the roller shaft 43 and the hollow space 64 to insert a spacer 67 (described later). The rollers 48 contact the separating pad 37 when the cutout surface portion 46 of the feed roller 36 is opposite the separating pad 37. Thus, each roller 48 serve as a space forming member to a form a gap between the cutout surface portion 46 and the separating pad 37.

Further, the separating pad 37 is disposed in a position opposing the feed roller 36. This separating pad 37 is formed of an elastic material having a frictional coefficient slightly lower than that of the roller body 44. A sheet receiving section 50 serves to support the separating pad 37. A depression is formed in the top surface of the sheet receiving section 50, allowing the separating pad 37 to be inset into the top surface of the sheet receiving section 50. A separating pad urging device 39 is provided for urging the separating pad 37 toward the feed roller 36. The separating pad urging device 39 includes a separating pad holder 49 for supporting the sheet receiving section 50, a stop member 51 disposed at a fixed position in both the first cassette accommodating section 19 and second cassette accommodating section 20, and a spring 52 interposed between the bottom surface of the sheet receiving section 50 and the stop member 51 for urging the separating pad holder 49 toward the feed roller 36.

Guide rollers 53, 54 are disposed near the downstream side of the feed roller 36 for conveying the sheet 27 fed by the feed roller 36 toward the image-forming unit 28. That is, the sheet 27 fed by the feed roller 36 enters between the guide rollers 53 and 54. The guide rollers 53 and 54 are driven to rotate, thereby conveying the sheet 27 toward the image-forming unit 28. A pair of spacers 67 each capable of being freely inserted between and removed from the rollers 48 and roller shaft 43 are provided to enable modification of the distance from the axial center of the roller shaft 43 to the point of contact between the rollers 48 and the separating pad 37, that is, the peripheral surface 61 of the rollers 48. Each spacer 67 has a hollow cylindrical portion 67A and a flange portion 68. The spacers 67 are provided around the roller shaft 43, one on the outer side of each of the rollers 48. The spacers 67 are capable of sliding freely along the roller shaft 43. By sliding the spacers 67 inward along the roller shaft 43, the spacers 67 can be inserted between the inner surface of the hollow spaces 64 formed in the rollers 48 and the outer surface of the roller shaft 43. By sliding the spacers 67 outward along the roller shaft 43, the spacers 67 can be removed from between the inner surfaces of the hollow spaces 64 and the outer surface of the roller shaft 43.

Annular engaging protrusions 69 are formed on the spacers 67. Each engaging protrusion 69 extends from the flange portion 68 radially inwardly toward the roller shaft 43. Annular insertion position fixing grooves 70 and annular non-insertion position fixing grooves 71 are formed in the roller shaft 43. The engaging protrusions 69 of the spacers 67 can be fitted into either the insertion position fixing grooves 70 or the non-insertion position fixing grooves 71. The insertion position fixing grooves 70 and non-insertion position fixing grooves 71 are positioned in order to fix the engaging protrusions 69 in an insertion position, in which the spacers 67 are inserted between the rollers 48 and the roller shaft 43, or a non-insertion position, in which the spacers 67 are not inserted between the rollers 48 and the roller shaft 43.

Figure 2:
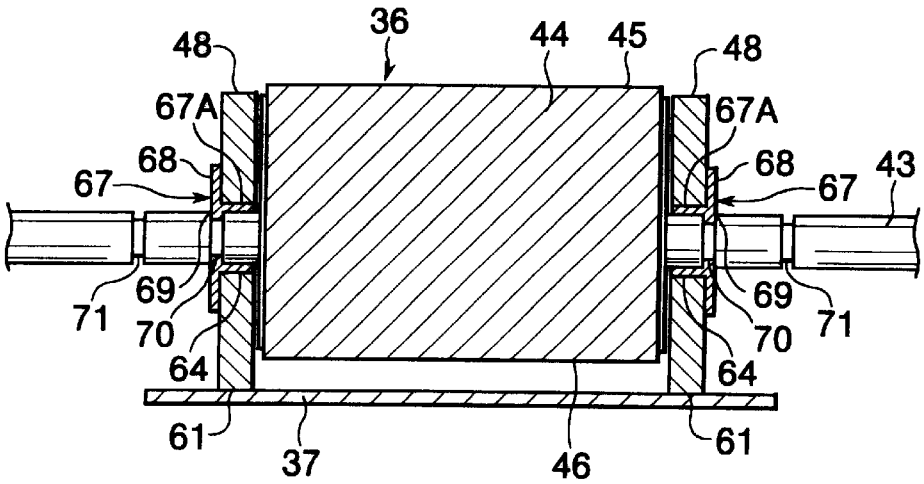
FIG. 2 is a cross-sectional view showing the sheet feeder in a state where each spacer is in its insertion position with respect to each roller.
Figure 3:
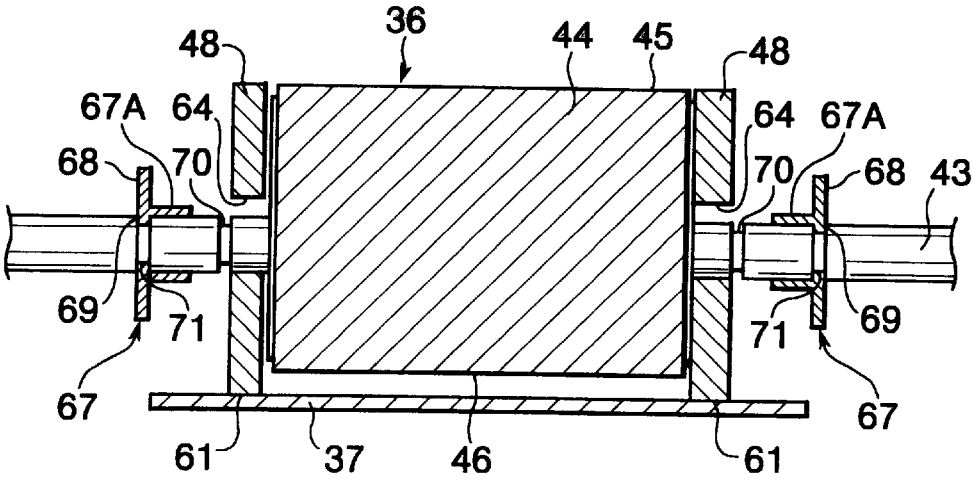
FIG. 3 is a cross-sectional view showing the sheet feeder in a state where each spacer is in the non-insertion position with respect to each roller.

As shown in FIG. 2, the spacers 67 can be fixed in the insertion position by inserting the spacers 67 between the rollers 48 and the roller shaft 43 and fitting the engaging protrusions 69 into the insertion position fixing grooves 70. As shown in FIG. 3, the spacers 67 can be fixed in the non-insertion position by removing the spacers 67 from between the rollers 48 and the roller shaft 43 and fitting the engaging protrusions 69 into the non-insertion position fixing grooves 71.

With the above-described sheet feeder 21 having the feed roller 36, rollers 48, spacers 67, and separating pad 37, it is possible to achieve accurate and reliable conveying of sheets 27. Next, the process of conveying sheets 27 with the sheet feeder 21 will be described with reference to FIGS. 4–7.

Figure 4:
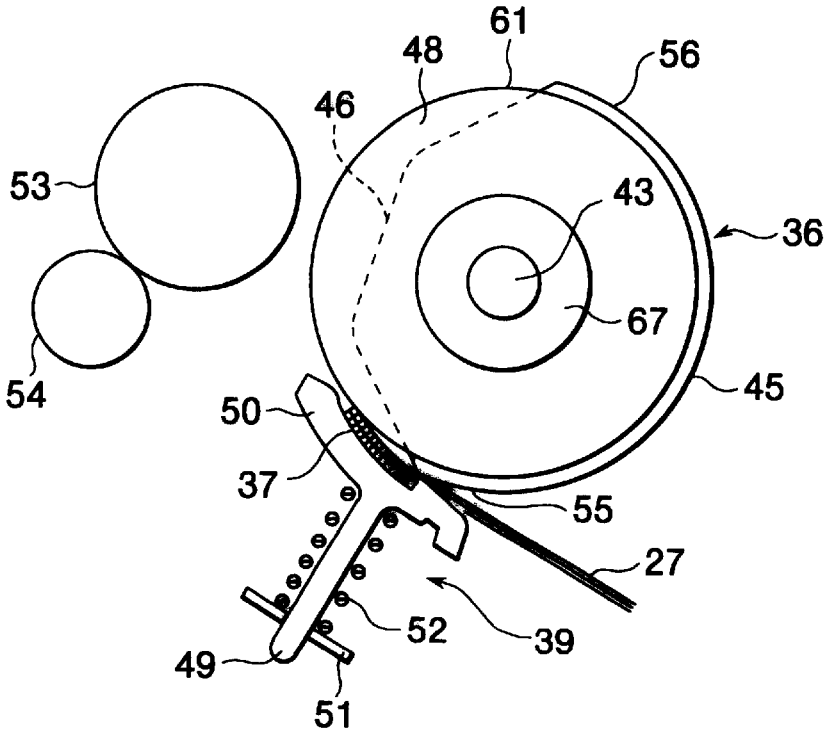
FIG. 4 is an explanatory diagram showing a state of the sheet feeder when a sheet enters a feed roller.

FIG. 4 is an explanatory diagram showing the state of the sheet feeder 21 when the feed roller 36 picks up and begins conveying the sheet 27. The sheets 27 stacked in the first cassette 25 and second cassette 26 are positioned near the upstream side of the feed roller 36 via the sheet urging device 38. The sheet 27 is fed between the feed roller 36 and the separating pad 37 by the rotation of the feed roller 36.

At this time, the sheet 27 contacts the entry contact portion 55 of the circumferential surface portion 45. At the moment the sheet 27 contacts the entry contact portion 55, the separating pad 37, which has been in contact with the two rollers 48, now contacts the circumferential surface portion 45 of the feed roller 36.

When feeding thick or heavy sheets, the spacers 67 are removed from the space between the rollers 48 and the roller shaft 43 and fixed in the non-insertion position shown in FIG. 3. Removing the spacers 67 creates play between the inner surface of the hollowed space 64 formed in the rollers 48 and the outer surface of the roller shaft 43. However, since the separating pad 37 applies pressure to the rollers 48, the outer surface on the bottom of the roller shaft 43 is forced to contact the inner surface of the hollowed space 64. Therefore, the rollers 48 can be moved upward by a distance corresponding to a thickness of the cylindrical portion 67A of the spacer 67. Accordingly, the difference between the radius of the circumferential surface portion 45 and the distance from the axial center of the roller shaft 43 and the peripheral surface 61 of the rollers 48 is larger than the corresponding difference when the spacers 67 are in the insertion position. This creates a larger bump when the separating pad 37 changes from contacting the rollers 48 to contacting the feed roller 36. As a result, the circumferential surface portion 45 of the feed roller 36 can apply a large amount of pressure to the separating pad 37, increasing the amount of conveying pressure on the sheet 27. Accordingly, even thick and heavy sheets can be reliably fed without empty feeds.

Figure 5:
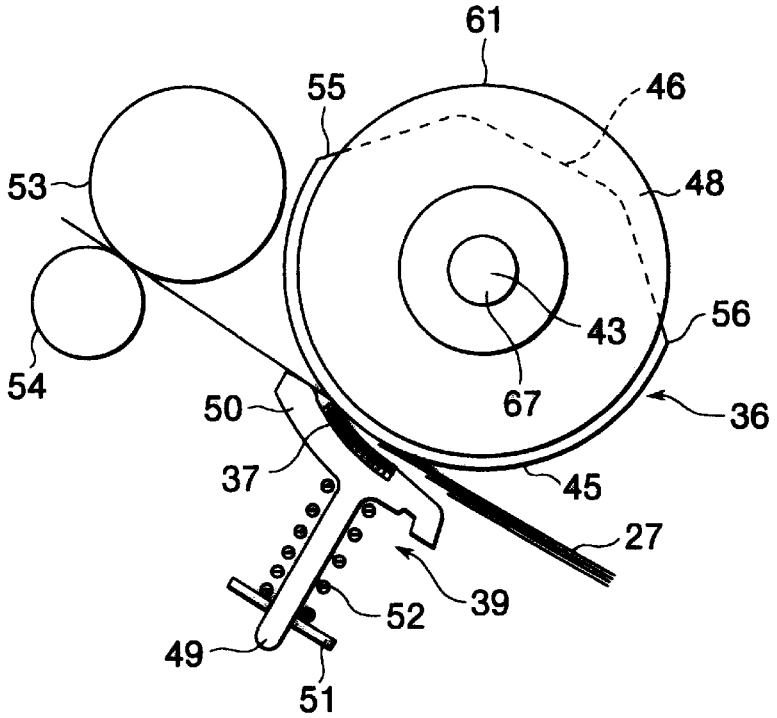
FIG. 5 is an explanatory diagram showing a state of the sheet feeder when the sheet is conveying by the feed roller.

On the other hand, when feeding thin or lightweight sheets, the hollow cylindrical portions 67A of the spacers 67 are inserted between the rollers 48 and the roller shaft 43 and fixed in the insertion position shown in FIG. 2. Therefore, the difference between the radius of the circumferential surface portion 45 and the distance from the axial center of the roller shaft 43 and the peripheral surface 61 of the rollers 48 is smaller than when the spacers 67 are in non-insertion position, creating a smaller bump when the separating pad 37 changes from contacting the rollers 48 to contacting the feed roller 36. As a result, the circumferential surface 45 of the feed roller 36 does not apply a large amount of pressure to the separating pad 37, thereby preventing a plurality of sheets from entering simultaneously between the circumferential surface portion 45 and the separating pad 37 due to changes in pressure. Accordingly, even thin and lightweight sheets can be reliably fed. Then, as shown in FIG. 5, the circumferential surface portion 45 of the feed roller 36 contacts and conveys the sheet 27 to the guide rollers 53 and 54.

Figure 6:
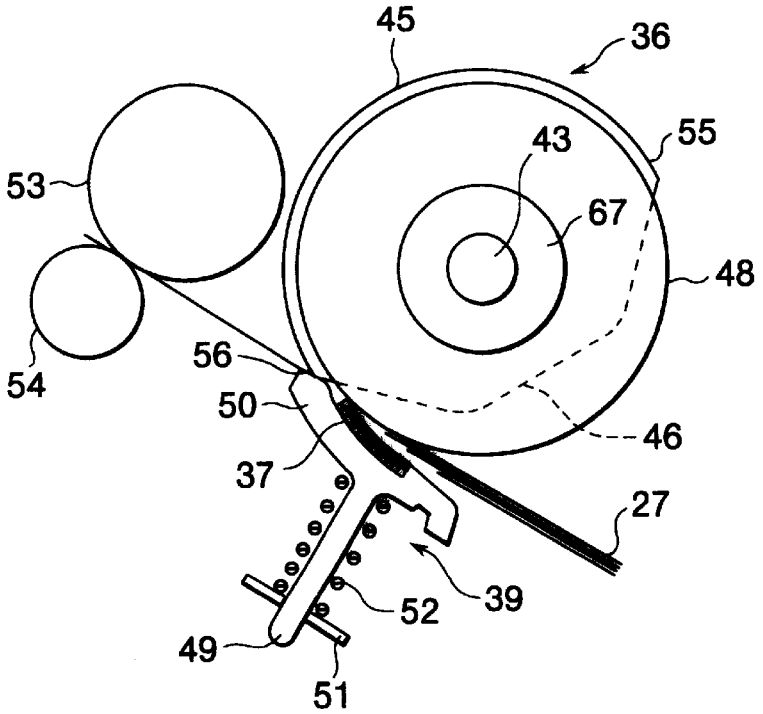
FIG. 6 is an explanatory diagram showing a state of the sheet feeder when the sheet separates from the feed roller.

FIG. 6 is an explanatory diagram showing the state of the sheet feeder 21 when the sheet 27 separates from the feed roller 36. As shown in FIG. 6, at the moment the sheet 27 separates from the exit contact portion 56 of the feed roller 36, the sheet 27, which until that time contacted the circumferential surface 45, now contacts the rollers 48.

At this time, if the spacers 67 are fixed in the non-insertion position, a large bump is created when the separating pad 37 changes from contacting the feed roller 36 to contacting the rollers 48. This bump generates a momentary state in which pressure is not applied to the sheet, since the pressure from the separating pad 37 cannot be maintained over this change in level. At this moment, the feeding of an overlapping sheet can easily occur, in which case the next sheet or plurality of sheets is conveyed along with the sheet currently being fed. Still however, since the spacers 67 ordinarily fixed in the non-insertion position are for the purpose of feeding thick or heavy sheets, such problem of overlapping sheet feeding is not likely to occur.

In contrast, the above described problem of feeding overlapped sheets can occur more easily with thin or light-weight sheets. In this case, the spacers 67 are fixed in the insertion position (FIG. 2), which decreases the size of the bump created when the separating pad 37 changes from contacting the feed roller 36 to contacting the rollers 48. Since it is not difficult for the separating pad 37 to maintain pressure over this slight change in level, the problem of feeding overlapped sheets is not likely to occur.

Figure 7:
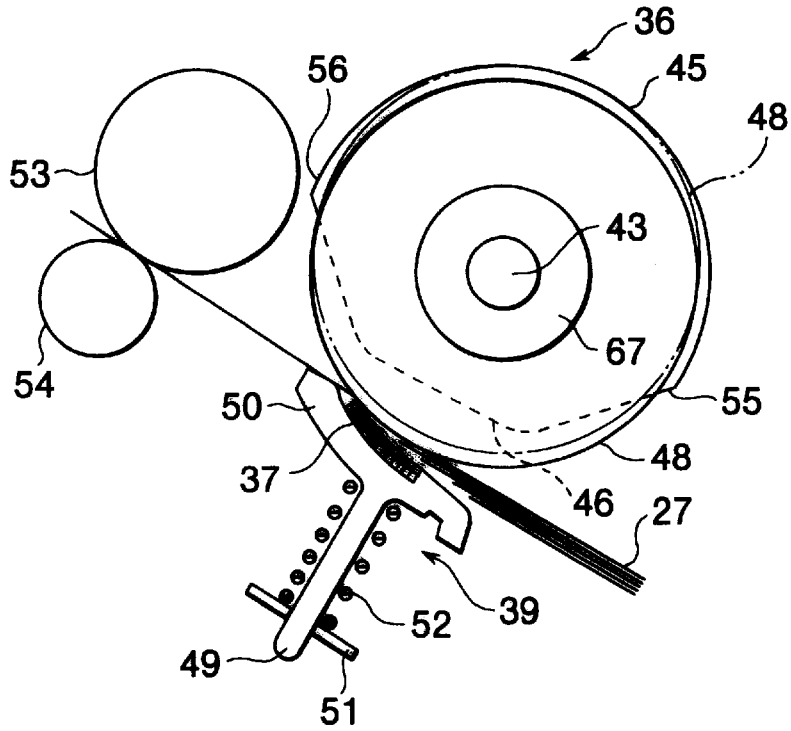
FIG. 7 is an explanatory diagram showing a state of the sheet feeder when the feed roller has completed conveying the sheet and is waiting to convey a next sheet.

FIG. 7 is an explanatory diagram showing the state of the sheet feeder 21 when the feed roller 36 has completed conveying the sheet 27 and is waiting to convey the next sheet 27. The feed roller 36 is stopped with the cutout surface portion 46 facing and separated by a prescribed distance from the separating pad 37. The sheet 27 fed by the feed roller 36 is conveyed toward the image-forming unit 28 by the rotation of the guide rollers 53 and 54. Although the sheet 27 receives pressure from the separating pad 37 at this time, the top surface of the sheet 27 is contacted by the rotating peripheral surfaces 61 of the rollers 48. Therefore, a prescribed space can be maintained between the sheet 27 and the cutout surface portion 46, and the guide rollers 53 and 54 can reliably convey the sheet 27. Since the rollers 48 are mounted on both sides of the feed roller 36, a gap between the cutout surface portion 46 and the separating pad 37 can be reliably provided when these rollers 48 are in contact with the separating pad 37. Thus, it is possible to achieve reliable conveying of sheets 27. Incidentally, in FIG. 7, the two dotted chain line representing the rollers 48 exaggeratingly indicates the position of the rollers 48 when the spacers 67 are fixed in the non-insertion position.

As described above, the distance from the axial center of the roller shaft 43 to the peripheral surface 61 of the rollers 48 can be easily and reliably changed by performing simple sliding operations to insert or remove the spacers 67. Hence, it is possible to selectively prevent either double sheet feeding or empty feeding. Accordingly, the sheets 27 can be reliably conveyed regardless of the thickness and weight of the sheet, improving reliability in sheet feeding.

If the sheet is manually inserted into the laser printer 22 through the manual insertion tray 58 (FIG. 1), the user manually places the sheets 27 in the tray 58. If the sheet 27 is not inserted sufficiently far into the manual insertion tray 58 to a position where they can be conveyed by the feed roller 36, then the sheet may not be fed, resulting in an empty feed. In this case, the spacers 67 are removed from the space between the rollers 48 and the roller shaft 43 and fixed in the non-insertion position to increase the bump caused when the separating pad 37 shifts from contacting the rollers 48 to contacting the feed roller 36. As a result, the circumferential surface portion 45 of the feed roller 36 applies a large amount of pressure to the separating pad 37, increasing the amount of conveying pressure on the sheet 27. Accordingly, even when the leading edge of the hand-fed sheet 27 has not been inserted far enough to reach a position in which the sheet 27 can be conveyed by the feed roller 36, it is still possible to reliably feed the sheet 27 without the likelihood of an empty feed.

Figure 8:
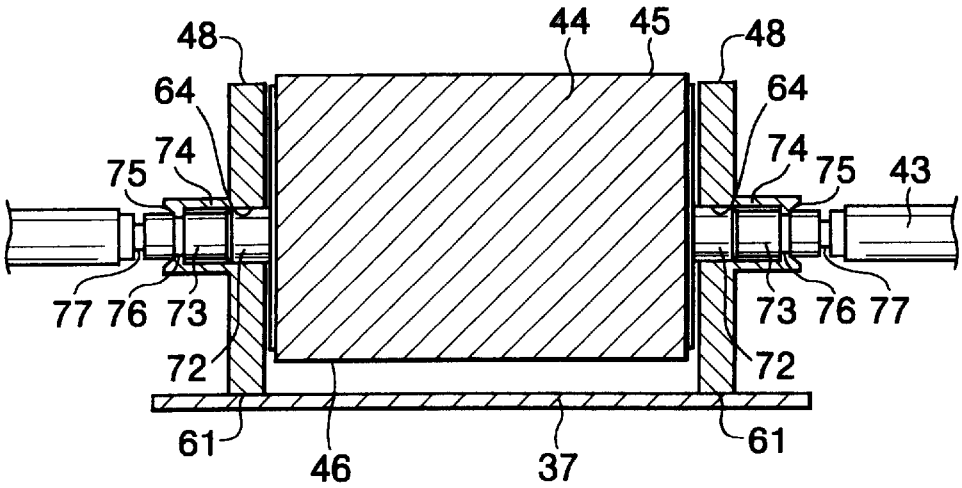
FIG. 8 is a cross-sectional view corresponding to FIG. 2 and showing a sheet feeder according to a second embodiment of the present invention.
Figure 9:
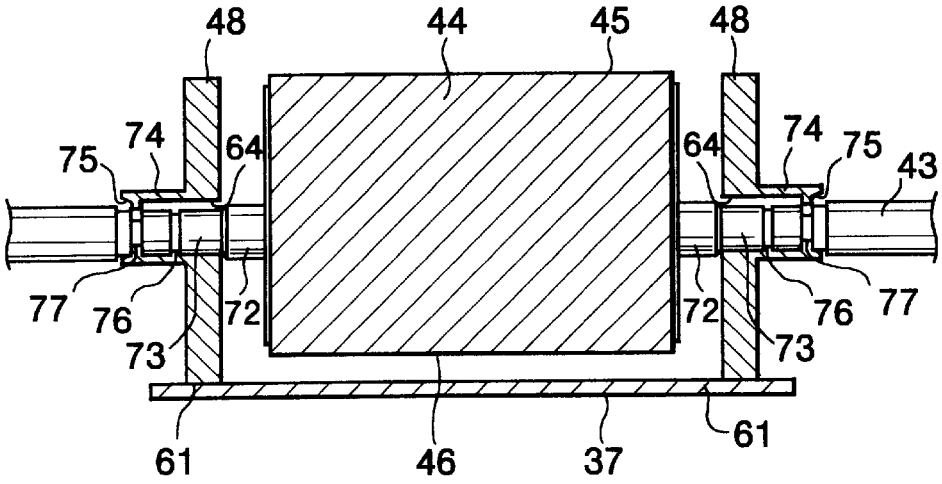
FIG. 9 is a cross-sectional view corresponding to FIG. 3 and showing the sheet feeder according to the second embodiment of the present invention.
Figure 10:
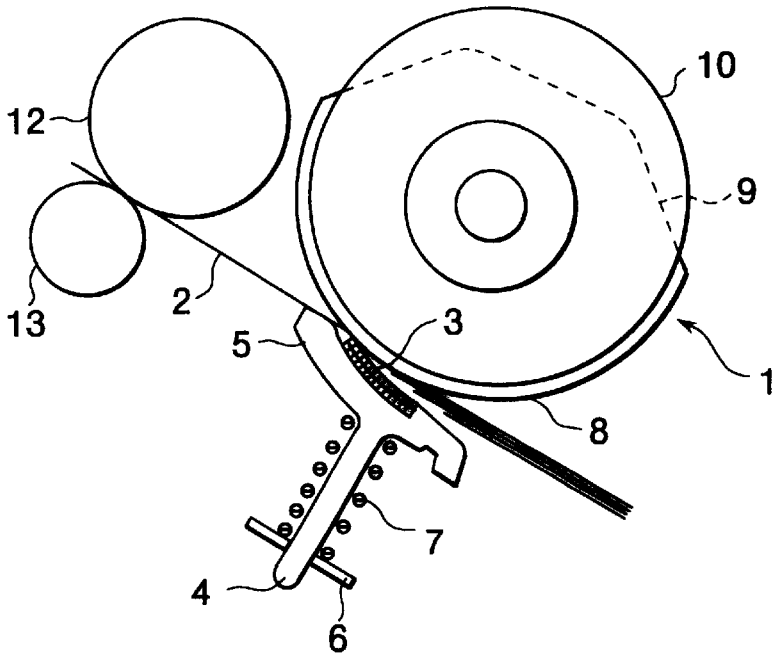
FIG. 10 PRIOR ART
FIG. 10 is a schematic view corresponding to FIG. 5 and showing a conventional sheet feeder.

A sheet feeder according to a second embodiment of the present invention will be described while referring to FIGS. 8 and 9. The roller shaft 43 is provided with at least two distinct diameter portions having different outer diameters. These distinct diameter portions take the place of the spacers 67 in the first embodiment for modifying the distance from the axial center of the roller shaft 43 to the peripheral surface 61 of the rollers 48 and are capable of supporting the rollers 48. The distinct diameter portions are disposed on both sides of the roller body 44 and include a large diameter portion 72 nearer the roller body 44 and a small diameter portion 73 farther from the roller body 44. The diameter of the hollow spaces 64 formed in the rollers 48 is approximately equal to the outer diameter of the large diameter portions 72. Cylindrical portions 74 are formed around the hollow spaces 64, extending outward in the axial direction. Annular engaging protrusions 75 are formed on the cylindrical portions 74, protruding toward the roller shaft 43. Annular large diameter position fixing grooves 76 and annular small diameter position fixing grooves 77 are formed in the roller shaft 43. The engaging protrusions 75 can be engaged with the large diameter position fixing grooves 76 in a large diameter position, in which the hollow spaces 64 are fit around the large diameter portions 72. Similarly, the engaging protrusions 75 can be engaged with the small diameter position fixing grooves 77, further outward in the axial direction than the large diameter position fixing grooves 76, in a small diameter position, in which the hollow spaces 64 are fitted around the small diameter portions 73. The rollers 48 are capable of freely sliding along the roller shaft 43. As shown in FIG. 8, the rollers 48 can be fitted around the large diameter portions 72 by engaging the engaging protrusions 75 with the large diameter position fixing grooves 76 and fitting the hollow spaces 64 of the rollers 48 around the large diameter portions 72 as shown in FIG. 8. Similarly, the rollers 48 can be fitted around the small diameter portions 73 by engaging the engaging protrusions 75 with the small diameter position fixing grooves 77 and fitting the hollow spaces 64 of the rollers 48 around the small diameter portions 73 as shown in FIG. 9.

By providing these distinct diameter portions, the rollers 48 can be supported on each of the diameter portions, and the distance between the axial center of the roller shaft 43 and the peripheral surfaces 61 of the rollers 48 can be modified by moving the rollers 48 in the axial direction of the shaft portion 43 to different diameter portions. In other words, the rollers 48 can be fitted onto the large diameter portions 72 to lengthen the distance between the axial center of the roller shaft 43 and the peripheral surface 61. Similarly, the rollers 48 can be fitted onto the small diameter portions 73 to shorten the distance between the axial center of the roller shaft 43 and the peripheral surface 61, because the pressure from the separating pad 37 causes the inner surfaces of the hollow spaces 64 to contact the outer bottom surface of the roller shaft 43. Therefore, rollers 48 can be fitted onto the large diameter portions 72 or the small diameter portions 73 simply by sliding the rollers 48, enabling the distance between the axial center of the roller shaft 43 and the peripheral surfaces 61 of the rollers 48 to be modified easily and reliably. Accordingly, this construction obtains the same usage and effects as those obtained in the first embodiment using the spacers 67.

While the invention has been described in detail and with reference to the specific embodiment thereof, it would be apparent to those skilled in the art that various changes and modifications may be made therein without departing from the spirit and scope of the invention. For example, the sheet feeder 21 of the foregoing embodiments enables the distance between the axial center of the roller shaft 43 and the peripheral surface 61 to be changed between two distances. However, it is possible to construct a sheet feeder 21 that is capable of changing this distance among three or more distinct distances by combining the two embodiments described above. Further, it is also possible to change among three or more distinct distances by altering the construction of the roller shaft 43 in FIGS. 8 and 9 to have three or more distinct diameter portions or to be formed in a tapered shape, enabling changes in distance to be smooth and continuous.

What is claimed is:

1. A sheet feeder for feeding each sheet of recording medium, comprising:

a feed roller having a roller shaft defining an axial center and a roller body provided with a circumferential surface portion having a first radius for contacting and conveying a sheet of a recording medium, and a cutout surface portion formed by cutting out a portion of the circumferential surface portion;

a separating pad opposing the feed roller and urged toward the feed roller for interposing the sheet between the separating pad and the feed roller;

a space forming member having a contact portion contacting the sheet and the separating pad and forming a space between the cutout surface portion and the separating pad when the cutout surface portion is facing the separating pad, the space forming member being provided around the roller shaft; and means for changing a distance from the axial center to the contact portion, the changing means being provided in association with the space forming member and the roller shaft, the distance being a constant distance between the cutout surface portion and the separation pad when the cutout surface portion is facing the separating pad, and the distance being selected by the changing means in accordance with a thickness and weight of the sheet.

2. The sheet feeder as claimed in claim 1, wherein the space forming member has a circular shape, and is formed with a cylindrical hollow space through which the roller shaft extends, the space forming member having a second radius slightly smaller than the first radius of the circumferential surface portion.

3. The sheet feeder as claimed in claim 2, wherein the changing means comprises a spacer detachably inserted between the cylindrical hollow space and the roller shaft.

4. The sheet feeder as claimed in claim 3, wherein the spacer is movable between a first position where the spacer is inserted between the cylindrical hollow space and the roller shaft and a second position where the spacer is displaced from the cylindrical hollow space, a first distance being defined between the contact portion and the axial center at the first position of the spacer and a second distance different from the first distance being defined therebetween at the second position of the spacer.

5. The sheet feeder as claimed in claim 3, wherein the spacer is provided around the roller shaft and is slidably movable in an axial direction of the roller shaft between an insertion position in which the spacer is inserted between the cylindrical hollow space and the roller shaft and a non-insertion position in which the spacer is removed from a space between the cylindrical hollow space and the roller shaft.

6. The sheet feeder as claimed in claim 5, wherein the roller shaft is formed with a first annular groove positioned close to the roller body and a second annular groove positioned farther from the roller body;

and wherein the changing means further comprises an engaging protrusion protruding radially inwardly from the spacer, the engaging protrusion being selectively engageable with one of the first annular groove and the second annular groove for selectively fixing one of the insertion position and the non-insertion position.

7. The sheet feeder as claimed in claim 6, wherein the roller body is formed of an elastic material and provides a first coefficient of friction, and wherein the separation pad has a second coefficient of friction lower than that of the first coefficient of friction.

8. The sheet feeder as claimed in claim 7, wherein the roller shaft is provided at each end of the roller body, and wherein the space forming member comprises two rollers each being rotatably mounted on each roller shaft.

9. The sheet feeder as claimed in claim 2, wherein the changing means comprises the roller shaft provided with at least two distinct diameter portions having diameters different from each other, the space forming member being movable in an axial direction of the roller shaft and selectively mounted on one of the at least two distinct diameter portions.

10. The sheet feeder as claimed in claim 9, wherein the distinct diameter portions comprise a large diameter portion and a small diameter portion, the cylindrical hollow space being selectively disposed over one of the large diameter portion and the small diameter portion in accordance with the axial movement of the space forming member.

11. The sheet feeder as claimed in claim 10, wherein the roller shaft is formed with a first annular groove at a position between the large diameter portion and the small diameter portion, and a second annular groove at a position beside the small diameter portion, and wherein the space forming member is coaxially provided with a hollow cylindrical member outwardly extending from the cylindrical hollow space;

and wherein the changing means further comprises an engaging protrusion protruding radially inwardly from the hollow cylindrical member, the engaging protrusion being selectively engageable with one of the first annular groove and the second annular groove.

12. The sheet feeder as claimed in claim 11, wherein the roller body is formed of an elastic material and provides a first coefficient of friction, and wherein the separation pad has a second coefficient of friction lower than that of the first coefficient of friction.

13. The sheet feeder as claimed in claim 12, wherein the roller shaft is provided at each end of the roller body, and wherein the space forming member comprises two rollers each being rotatably mounted on each roller shaft.

14. An image forming device, comprising:

a casing having at least one cassette accommodating section;

at least one cassette maintaining a stack of sheets and detachably mounted on the at least one cassette accommodating section;

a sheet feeder provided immediately downstream of the at least one cassette, the sheet feeder comprising:

a feed roller having a roller shaft defining an axial center and a roller body provided with a circumferential surface portion having a first radius for contacting and conveying a sheet of a recording medium, and a cutout surface portion formed by cutting out a portion of the circumferential portion;

a separating pad opposing the feed roller and urged toward the feed roller for interposing the sheet between the separating pad and the feed roller;

a space forming member having a contact portion contacting the sheet and the separating pad and forming a space between the cutout surface portion is facing the separating pad, the space forming member being provided around the roller shaft; and means for changing a distance from the axial center to the contact portion, the changing means being provided in association with the space forming member and the roller shaft, the distance being a constant distance between the cutout surface portion and the separation pad when the cutout surface portion is facing the separating pad, and the distance being selected by the changing means in accordance with a thickness and weight of the sheet;

a pair of guide rollers provided immediately downstream of the sheet feeder for conveying each sheet fed by the sheet feeder; and an image forming unit positioned downstream of the pair of guide rollers for forming an image on the sheet fed by the pair of guide rollers, the image forming unit comprising a photosensitive drum and a transfer roller in confronting relation to the photosensitive drum.

15. The image forming device as claimed in claim 14, further comprising:

a manual sheet insertion section provided between the pair of guide rollers and the image forming unit for manually inserting a sheet into the casing and toward the image forming unit; and another sheet feeder provided immediately downstream of the manual sheet insertion section, the another sheet feeder providing an arrangement identical with the sheet feeder comprising the feed roller the separation pad, the space forming member and the means for changing the distance.

16. The image forming device as claimed in claim 15, wherein the space forming member has a circular shape, and is formed with a cylindrical hollow space through which the roller shaft extends, the space forming member having a second radius slightly smaller than the first radius of the circumferential surface portion.

17. The image forming device claimed in claim 16, wherein the changing means comprises a spacer detachably inserted between the cylindrical hollow space and the roller shaft.

18. The image forming device as claimed in claim 17 wherein the spacer is provided around the roller shaft and is slidably movable in an axial direction of the roller shaft between an insertion position in which the spacer is inserted between the cylindrical hollow space and the roller shaft and a non-insertion position in which the spacer is removed from a space between the cylindrical hollow space and the roller shaft.

19. The image forming device as claimed in claim 15, wherein the changing means comprises the roller shaft provided with at least two distinct diameter portions having diameters different from each other, the space forming member being movable in an axial direction of the roller shaft and selectively mounted on one of the at least two distinct diameter portions.

20. The image forming device as claimed in claim 19, wherein the distinct diameter portions comprise a large diameter portion and a small diameter portion, the cylindrical hollow space being selectively disposed over one of the large diameter portion and the small diameter portion in accordance with the axial movement of the space forming member.

* * * * *